United States Patent [19]

Littlefield

[11] 4,178,707

[45] Dec. 18, 1979

[54] DISPLAY APPARATUS UTILIZING MAGNETIC MATERIALS

[76] Inventor: John V. Littlefield, Box 69507, Los Angeles, Calif. 90069

[21] Appl. No.: 816,298

[22] Filed: Jul. 18, 1977

[51] Int. Cl.[2] ..... G09F 19/00

[52] U.S. Cl. ..... 40/426; 40/538; 46/236

[58] Field of Search ..... 40/426, 538; 46/236, 46/238

[56] References Cited

U.S. PATENT DOCUMENTS

| | | | |
|---|---|---|---|
| 2,323,837 | 7/1943 | Neal | 40/426 |
| 2,471,002 | 5/1949 | Mohr | 40/426 |
| 2,702,191 | 2/1955 | Lemelson | 40/426 |
| 3,006,111 | 10/1961 | Koch | 40/426 |
| 3,964,746 | 6/1976 | MacMurdo | 46/238 |

FOREIGN PATENT DOCUMENTS

| | | | |
|---|---|---|---|
| 574516 | 3/1958 | Italy | 40/426 |

*Primary Examiner*—John F. Pitrelli
*Assistant Examiner*—G. Lee Skillington
*Attorney, Agent, or Firm*—Herzig & Walsh, Inc.

[57] ABSTRACT

A display apparatus of the type wherein an object is supported by magnetic force to create the illusion that the object is floating or flying. In the apparatus, the magnetic force is balanced against gravity. Magnetized material is utilized which may be alnico, ceramic, or other compound or alloy or a material such as rubber bonded barium ferrite composition, the material being magnetized through the thickness or diameter of the material. That is, the magnetic material may be in the form of a flat elongated bar or a cylindrical bar or the like. The N pole is opposite the S pole over the entire surface area of the material as distinguished from a rod or bar that is magnetized through the length with the N pole at one end and the S pole at the opposite end. A magnetic environment or field is created whereby the object to be displayed can be floated in a state of dynamic equilibrium in a stable condition over the magnetic material, the object, of course, having magnetic material within it magnetized so as to have a like pole facing or opposite a like pole of the said material. Improved action and performance is realized by the arrangement as described.

12 Claims, 14 Drawing Figures

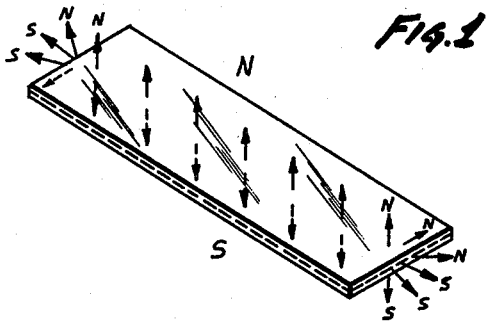
FIG. 1
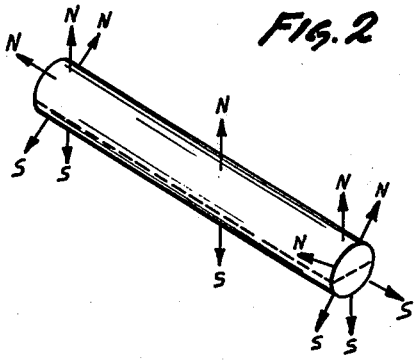
FIG. 2
FIG. 1a
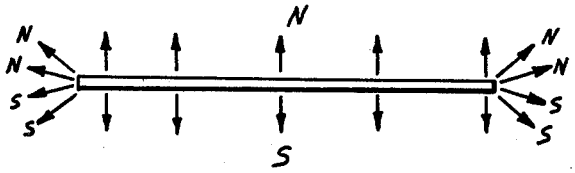
FIG. 2a
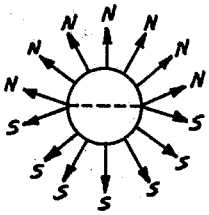
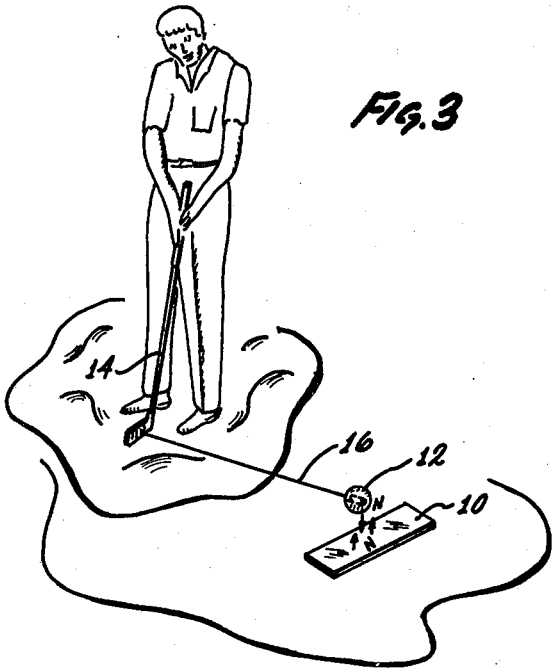
FIG. 3

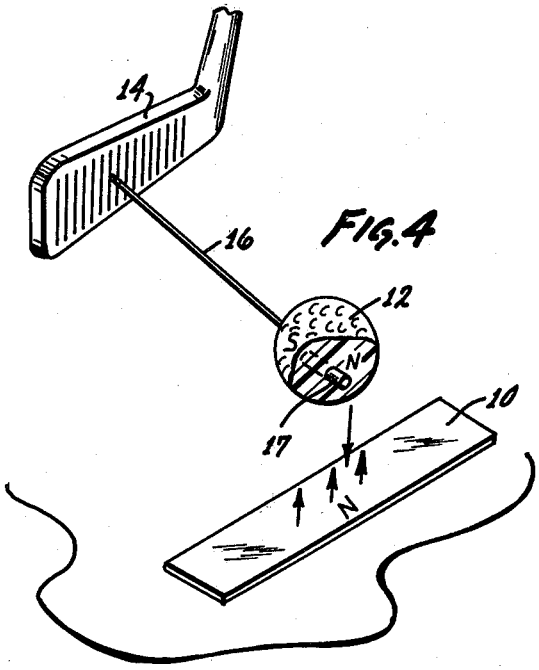
FIG. 4
FIG. 5
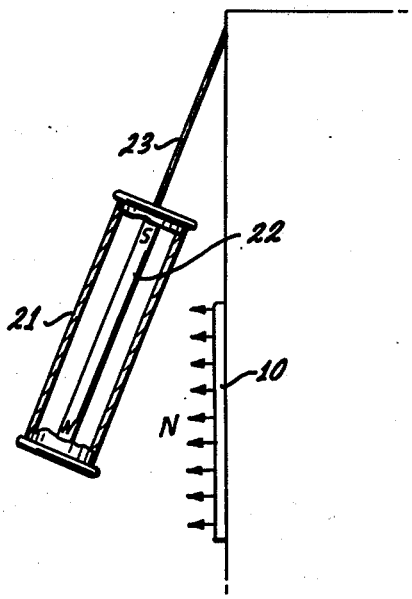
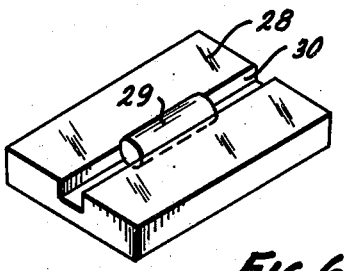
FIG. 6
FIG. 7
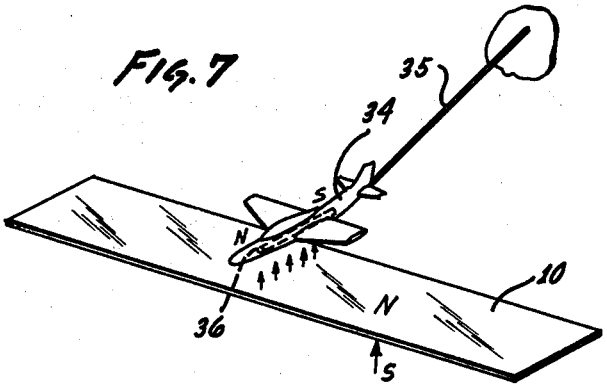

DISPLAY APPARATUS UTILIZING MAGNETIC MATERIALS

BACKGROUND OF THE INVENTION

1. Field of the Invention

The field of the invention is that of display apparatus of the type wherein a magnetic field is created and an object having a magnet within it is supported by the field in opposition to gravity to create the illusion of floating or flying.

2. Description of the Prior Art

The herein invention is an improvement in that of U.S. Pat. No. 3,196,566 wherein the herein inventor is the patentee. The patents cited against U.S. Pat. No. 3,196,566 reflect further prior art. The display device of U.S. Pat. No. 3,196,566 is fully operative and is commercially successful. It utilizes bar magnets 20 and 24 which are magnetized along their length so that one end is a North pole and the other end is a South pole. This patent does not embody the specific improvements as described in detail hereinafter.

SUMMARY OF THE INVENTION

The invention is an improvement in a display device as identified in the abstract and as referred to in the description of the prior art with reference to the earlier U.S. Pat. No. 3,196,566.

The herein invention relates to the same or similar type of display device but with significantly improved characteristics.

The display device is of a type wherein an object which may be an aircraft or a missile or any other object is made to appear floating freely in space. The object to be floated has a magnet in it and the object appears to be floating by reason of magnetic repulsion forces between the magnet in the object and the magnet or magnets in the base. Normally some type of connection to the object is necessary and the visibility of this connection is minimized to enhance the illusion of free-floating of the object.

The improved characteristics of the herein invention result from the discovery and/or recognition of the characteristics of certain magnetizable materials that may be in a form other than an elongated rod or bar. The materials may include such materials as alnico, ceramic, plastic, rubber bonded barium ferrite composite materials capable of being magnetized through a width or thickness dimension or a diameter. That is, the material may be in the form of a flat bar or a cylinder so magnetized that a field is created with an N pole opposite an S pole over the entire surface area of the material as distinguished from a rod or bar that is magnetized longitudinally, that is through the length to produce an N pole at one end and an S pole at the opposite end.

Materials as referred to wherein the magnetization is such that one pole is represented by an entire surface and another pole by an entire opposite or diametrically opposed surface, the magnetization being through the width, thickness, or diameter create a magnetic environment or field wherein an object can be floated in a state of equilibrium in a perfectly stable condition of free flight. The result is achieved by concealing within the object magnetic material having a like pole facing a like pole of the material that has been magnetized as stated to produce magnetic repulsion forces. Also, the object to be floated can be made out of similar material.

In this type of device, one of the difficulties to be overcome is, of course, that of realizing stability so that the floated object will stay in position as desired with respect to the magnetic field. The herein invention makes possible significantly improved stability by way of limiting the length of the tether that is secured to the floated object so that the floated object can never get in close enough proximity to an opposite magnetic pole so that it would be pulled from a free-floating position by an attractive magnetic force causing it to come to rest against an opposite pole. The floated object can, of course, be any object such as for example a model airplane, train, automobile, missile, space capsule, football, basketball, boat, fish, mattress, beer can, oil can, soup can, tire, blimp, etc. The nature of this particular characteristic of the improved display device will become apparent from the following detailed description of the preferred embodiment.

A further advantage of using magnetic material having a form as described is that magnet can be used on ferrite metal surfaces so that the free-floating effect can be achieved with the base magnet at various angles other than horizontal and the base magnet can be applied magnetically or adhesively to a metal or other surface such as a shelf, door, drawer, wall, window or etc.

In the light of the foregoing, the primary object of the invention is to provide an improved display device of the type referred to wherein an object embodying a magnet is floated in a magnetic field, the apparatus embodying field producing means in the form of magnetized material having a single polarity over an entire surface thereof.

A further object is to provide improved display apparatus as in the foregoing object, wherein the supporting field producing material is in the form of a relatively flat piece of material having length, width, and thickness dimensions and having single polarity over an entire surface thereof.

A further object is to provide an improved display apparatus as in the foregoing characterized in that the magnetic material providing the support field can be attached or applied magneticly or adhesively to a metal surface.

A further object is to realize a unique device utilizing the principles of the invention wherein means are provided for moving the supporting magnetic material or magnets underneath the object so that the repulsion forces are varied to cause the object to move up and down.

A further object is to realize a device as in the foregoing having a plurality of supporting magnets with spaces or gaps between them with means for rotating the magnets of alternatively, reciprocating them linearly underneath the object which may be a miniature airplane to impart motion to the airplane by causing it to be alternately lifted and allowed to drop down.

BRIEF DESCRIPTION OF THE DRAWINGS

FIG. 1 is an isometric view of a magnet in the form of a flat bar of magnetized material having a single polarity over an entire surface thereof;

FIG. 1*a* is a side view of the magnet of FIG. 1;

FIG. 2 is an isometric view of a cylindrical member of magnetic material which is magnetized through a diameter thereof so that half of the cylindrical surface is of a single polarity;

FIG. 2*a* is an end view of the member of FIG. 2;

FIG. 3 is a schematic view of an embodiment of the invention wherein an object which is a golf ball is floated;

FIG. 4 is a view of an embodiment similar to FIG. 3 with a bar or rod magnet in the ball with its end having a polarity opposite to the polarity of the top side of the base magnet;

FIG. 5 is a schematic view of a modified form of the invention wherein the base magnet is applied in an angular position to a vertical ferrite surface, an article having a bar or rod magnet in it being suspended relative to the base magnet;

FIG. 6 is a schematic illustrative view of a modified form of the invention wherein a cylindrical magnet which is magnetized through a diameter is positioned in a slot or groove in the surface which may have any relative position such as vertical;

FIG. 7 is a schematic view of a form of the invention wherein an article such as a model aircraft having a bar or rod magnet in it is suspended over the surface of the flat magnet;

DESCRIPTION OF THE PREFERRED EMBODIMENTS

Figure 8:
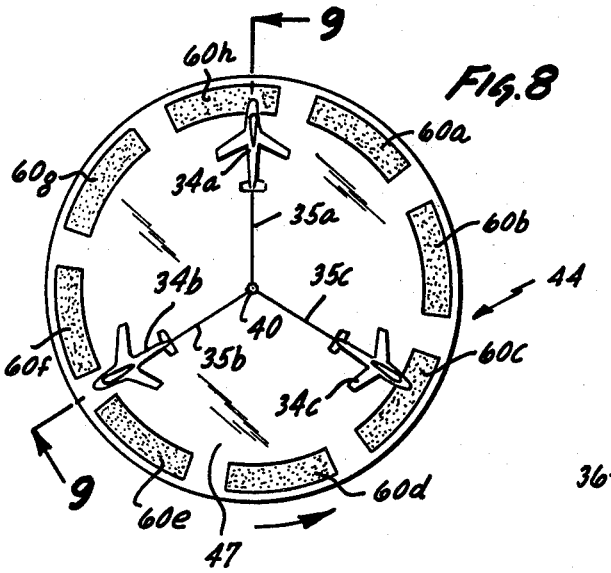
FIG. 8 is a plan view of a modified form of the invention.

Referring to FIG. 1 and FIG. 1*a* of the drawings, they show a piece of magnetic material which as shown in rectangular in shape, having width, length, and thickness dimensions. The thickness could, of course, be greater than that shown. Magnetic material as shown is magnetized through its thickness dimension so that the magnetic field is that illustrated by the arrows, there being an N pole over the entire surface on one side of the magnet and an S pole over the entire surface on the opposite side. Material which may have a shape or configuration as shown in FIG. 1 that can be magnetized as described, is readily available and this material may be, as stated in the foregoing, alnico, ceramic, plastic, paper, rubber, or any compound of materials such as rubber bonded barium ferrite composite material. FIG. 1*a* is further illustrative of the environmental magnetic field around the material.

FIGS. 2 and 2*a* illustrate another form of magnet which may be made of a similar material wherein the magnet is of cylindrical conformation. In this case the magnet is magnetized through a diameter so that the field is as illustrated in these figures. As may be seen, one-half of the cylindrical surface on one side is of one polarity and the other half of the cylindrical surface on the other side of the magnet is of the opposite polarity.

The discovery has been made of peculiar advantage that can be taken of the particular characteristics of materials magnetized as described in the foregoing, resulting in the conception of significant improvements in display devices of the type referred to in the foregoing. FIG. 3 illustrates one embodiment of the invention. In this figure, numeral 10 illustrates a magnet having a shape as illustrated in FIGS. 1 and 1*a* and magnetized in that manner, that is, so that a surface of the magnet is of a single unitary polarity indicated by the arrows in FIG. 3. The material may be any of those identified in the foregoing. In this embodiment, numeral 12 identifies a golf ball or simulated golf ball, although it could be any object. Ball 12 is magnetized so as to present a surface having a polarity opposed to the polarity on the upper or exposed surface of the magnet 10. Thus, magnetic repulsion forces are created between the magnet 10 and the magnet within the ball 12. Numeral 14 designates a golf club or a part of a golf club with a tether 16 connected between the face of the club 14 and the ball 12. The magnet 10 and the club or partial club 14 can, of course, be supported from any suitable surface, such as a wooden or plastic base or platform.

FIG. 4 shows a form of the invention which is similar to that of FIG. 3. In this form of the invention, there is provided a bar or rod magnet 17 positioned in the ball 12 in a position transverse to the base magnet 10. The upper surface of the base magnet 10 may be a north pole and the end of the magnet 17 over the surface of the magnet 10 is a like pole so that there is repulsion and the ball floats as previously described. The tether is of a length to prevent the south pole at the other end of the bar magnet coming into proximity to the magnet 10 so as to be attracted. Improved stability is provided.

FIG. 5 shows another embodiment of the invention which utilizes a particular characteristic of the type of magnet used. FIG. 5 schematically illustrates the magnet 10 magnetically attached to a vertical ferrite surface in a position which may be angularly oriented, that is, with the length of the material neither vertical or horizontal. Numeral 21 illustrates an object which is shown, for example, simply as a cylindrical object. The material 10 is magnetized as already described. Within the object or article 20 is a bar magnet 22 with its N pole at the lower end. The magnetic repulsion force acts on the N pole of the bar magnet to position the article over the magnetic material, the article being suspended by means of a tether 23. Thus, as may be seen, the material can be magnetically or adhesively secured to any appropriate metal or other surface and the display affect achieved as described.

FIG. 6 illustrates schematically another form of the invention. Numeral 29 designates a cylindrical magnet magnetized as described in connection with FIGS. 2 and 2*a*. The magnet is positioned in a slot 30 in a surface 28 as shown. The surface 28 can be vertical, of course. Articles can be suspended with respect to the magnet 29 as illustrated in FIGS. 4 and 5. By placing the magnet 29 in a slot or groove as shown and by appropriate coloration, the magnet can be made to have very limited visibility so that various effects can be realized by having an object held and positioned adjacent to it in the matter described in the foregoing.

FIG. 7 illustrates another form of the invention, the magnet 10 being like that of previous embodiments. Numeral 34 designates an object which, by way of an example, can be a model airplane positioned over the magnet 10 and tethered by way of a tether 35. Within the model airplane 34 is a bar or rod magnet 36 having its N pole at its forward end which is positioned over the surface of magnet 10 so that there is repulsion of this end of the bar magnet. The tether 35 is of such a length that the bar or rod magnet 36 cannot come into a position relative to the surface 10 such that the south pole would be attracted by the magnet 10. Thus, it can be seen that considerable lateral or side-to-side motion of the model airplane is possible while still retaining stability. The improvement in this respect is substantial. This gain in stability and improvement in the uniqueness of the display effect can be realized in other and alternative variations of the arrangement.

Figure 9:
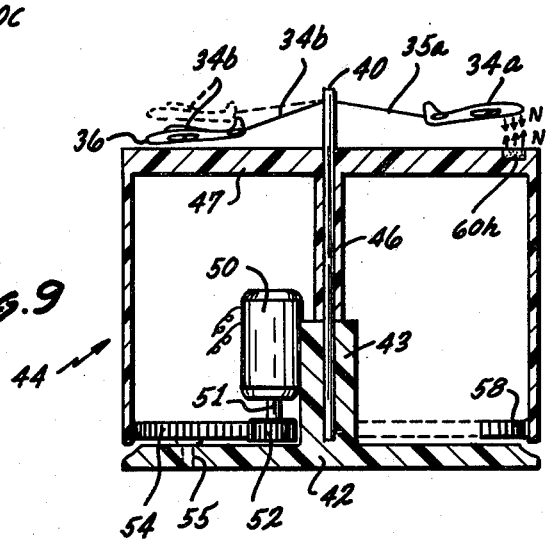
FIG. 9 is a sectional view taken along line 9—9 of FIG. 8.

FIGS. 8 and 9 show a modified form of the invention wherein dynamic motion is imparted to the suspended object which again may be an aircraft. These figures show three miniature airplanes 34*a*, 34*b* and 34*c* suspended in spaced angular positions by tethers 35*a*, 35*b* and 35*c* from a center stem 40. The stem is supported by a base 42 having a boss 43 upstanding therefrom and from which the stem 40 extends. Numeral 44 designates a cup-shaped member which is rotatable around the stem 40, there being a bushing 46 interposed between the top 47 of the member 44 and the boss 43. Numeral 50 designates a motor having a shaft 51 that drives a gear 52 which meshes with a gear 54 on an axle or stem 55. Around the inside of the bottom part of the cup 44 is an annular gear 58. Gear 54 meshes with 58 to drive the cup 44.

Positioned in the surface of the top 47 of the cup 44 are arcuate flat magnets 60*a*–60*h* which are like the magnets previously described, these magnets being flush with the surface of the top member 47. Each of the airplanes 34 has in it a rod or bar magnet like that of airplane 34 of FIG. 7 so that the airplanes can be suspended over the magnets in the manner as illustrated in FIG. 9, the N pole, for example, of the rod magnet in the airplane being over a magnet surface that has an N polarization, that is, the polarities are the same to provide repulsion.

In operation, the motor causes the cup 40 to rotate so that the arcuate magnets move circularly below the miniature airplanes. Thus, normally, the airplanes are suspended as illustrated in FIG. 9. As the magnets in the top 47 rotate underneath the airplanes, when the gaps between magnets pass under the airplanes, they tend to drop momentarily and are again lifted when the gap has passed. Thus, the effect is to transmit to the airplanes an undulating up-and-down motion producing an effect similar to that of an airplane in flight.

Figure 10:
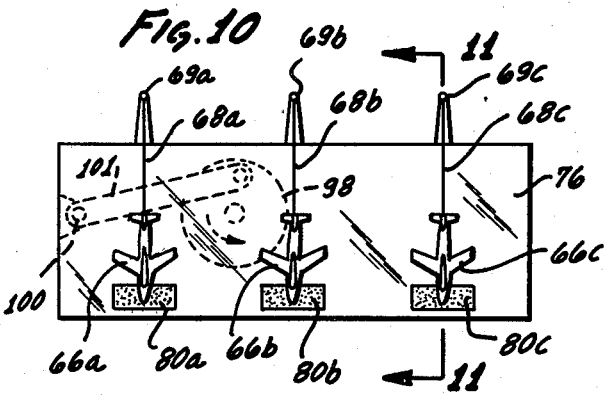
FIG. 10 is a plan view of another modified form of the invention.
Figure 11:
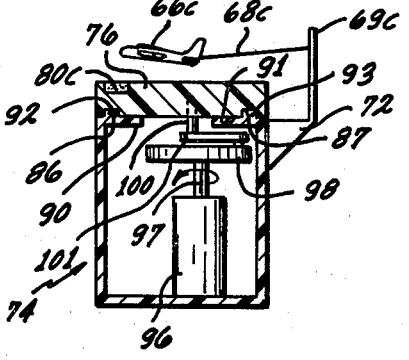
FIG. 11 is a sectional view taken along line 11—11 of FIG. 10.
Figure 12:
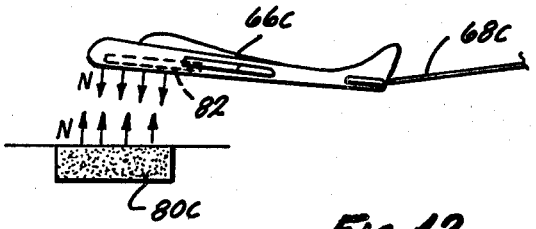
FIG. 12 is a detail view illustrating the action in FIGS. 10 and 11.

FIGS. 10, 11 and 12 show another form of the invention which is similar to that of FIGS. 9 and 10 but wherein the motion is imparted to tha aircraft by way of reciprocating the magnets linearly. These figures have miniature aircraft as shown at 66*a*, 66*b* and 66*c* attached by tethers 68*a*, 68*b* and 68*c* to posts 69*a*, 69*b* and 69*c* upstanding from a bracket 72 carried on a rectilinear housing 74 having a top 76. Positioned in the top 76 are flat bar magnets 80*a*, 80*b* and 80*c* which are like magnets previously described. Each of the miniature airplanes, such as the airplane 66*c* has in it a rod or bar magnet 82 as in the previous embodiments so that the aircraft can be supported over the bar magnets as illustrated in FIG. 12.

Formed in the bottom of the top member 76 are longitudinal slots 86 and 87, the housing 74 having top portions 90 and 91 with upstanding ribs 92 and 93 fitting into the slots 86 and 87 so that the top 86 carrying the magnets can slide linearly underneath the airplanes 66.

Numeral 96 designates a motor having a shaft 96 which drives a rotor 98. Numeral 100 designates a stem carried by the top 76 which is connected to the rotor 98 by a linkage 101 so that when the motor operates, the top member 76 is reciprocated linearly to move the magnets 80 correspondingly underneath the airplanes 66. In this manner, the gaps between magnets 80 are momentarily moved underneath the bar magnets in the airplanes so that they momentarily will tend to drop down until the magnets are moved back into their normal positions. In this manner, an undulating up-and-down motion is imparted to the aircraft similarly to that of the previous embodiment.

From the foregoing, those skilled in the art will readily understand the nature of the invention and the manner in which the effects are described or realized.

The foregoing disclosure is representative of preferred forms of the invention and is to be interpreted in an illustrative rather than a limiting sense, the invention to be accorded the full scope of the claims appended hereto.

What is claimed:

1. A display apparatus for maintaining an object in an apparently unsupported position, the apparatus including a sheet-like body of magnetic material having a continuous flat surface area, the material being magnetized in such a way that the entire surface area is of the same polarity, an object being magnetized in a region of less lateral extent than said area and adapted to be maintained in a position spaced from said surface, said object being polarized such as to be acted on by repulsive magnetic force of said material and gravity, means including a tether attached to said object for restraining it, the tether having a position in relation to the dimensions of said piece of material that the object is normally held in a stabilized position whereby if the object is displaced laterally with respect to said surface it will return to said stable position.

2. Apparatus as in claim 1, wherein the object embodies a magnet having a pole positioned so that repulsive magnetic forces act between the object and said piece of material.

3. Apparatus as in claim 1, wherein said piece of material is juxtaposed against a paramagnetic metal surface and the said object is held in a floating position spaced from said piece of material.

4. Apparatus as in claim 3 wherein said piece of material is juxtaposed against a vertical paramagnetic metal surface, the said object being suspended from above the piece of material.

5. Apparatus as in claim 2 wherein the said object has embodied in it a piece of magnetic material having a surface area magnetized so that it has an entire surface area of a single unitary polarity opposed to the surface polarity of the first mentioned material.

6. A display apparatus for maintaining an object in an apparently unsupported position, the apparatus including a flat piece of magnetic material having a continuous surface area, the material being magnetized in such a way that the entire surface area is of the same polarity, an object adapted to be maintained in a position spaced from said surface in a position creating the illusion of floating, said object being such as to be acted on by repulsive magnetic force of said material, and gravity, said object embodying magnetic means having poles of less lateral extent than said surface and arranged to provide for repulsive magnetic force between the object and the said material whereby to keep the object in a stable floating position and restraining means whereby only a magnetic pole of like polarity of said object can be brought into proximity to said surface area.

7. Apparatus as in claim 6 including a tether attached to the object whereby it is held in suspended position.

8. Apparatus as in claim 7 including means for moving said piece of magnetic material in a manner whereby the repulsive magnetic force is varied so as to impart motion to the object.

9. Apparatus as in claim 8 including a plurality of said pieces of magnetic material having spaces between them, the moving means being constructed to move the pieces of magnetic material and spaces beneath the object.

10. Apparatus as in claim 9 including means for moving the said pieces of magnetic material circularly.

11. Apparatus as in claim 10 including a plurality of said objects having tethers holding them in spaced angular positions with respect to the pieces of magnetic material.

12. Apparatus as in claim 9 including means for reciprocating the said pieces of magnetic material linearly beneath the object.

* * * * *